US012584375B2

(12) United States Patent
Theriot et al.

(10) Patent No.: US 12,584,375 B2
(45) Date of Patent: Mar. 24, 2026

(54) INTEGRATED INJECTION SYSTEM

(71) Applicant: OneSubsea IP UK Limited, London (GB)

(72) Inventors: Phillip Theriot, Houston, TX (US); Christopher Kochenower, Houston, TX (US); Gustavo Gonzalez, Houston, TX (US); Pierre Petit, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/806,360

(22) Filed: Aug. 15, 2024

(65) Prior Publication Data

US 2025/0059851 A1 Feb. 20, 2025

Related U.S. Application Data

(60) Provisional application No. 63/535,308, filed on Aug. 29, 2023, provisional application No. 63/532,856, filed on Aug. 15, 2023.

(51) Int. Cl.
*E21B 34/04* (2006.01)

(52) U.S. Cl.
CPC ..... *E21B 34/04* (2013.01)

(58) Field of Classification Search
CPC ..... E21B 34/04; E21B 34/045; E21B 34/025; E21B 43/013; E21B 43/017
See application file for complete search history.

(56) References Cited

U.S. PATENT DOCUMENTS

| | | | | |
|---|---|---|---|---|
| 10,570,712 | B2 * | 2/2020 | Mujica | E21B 47/008 |
| 2017/0356265 | A1 * | 12/2017 | Strand | E21B 43/101 |
| 2018/0156004 | A1 * | 6/2018 | Hussain | E21B 43/0175 |
| 2020/0063520 | A1 * | 2/2020 | Holberg | E21B 33/043 |
| 2020/0224510 | A1 | 7/2020 | Zaragoza Labes | |
| 2021/0025264 | A1 * | 1/2021 | Shirani | E21B 41/0007 |
| 2021/0293141 | A1 * | 9/2021 | Rossi | G05D 21/00 |

FOREIGN PATENT DOCUMENTS

| | | | | |
|---|---|---|---|---|
| WO | 2021102277 | A1 | 5/2021 | |
| WO | WO-2022120193 | A1 * | 6/2022 | E21B 34/066 |
| WO | 2022207666 | A1 | 10/2022 | |

* cited by examiner

*Primary Examiner* — Yanick A Akaragwe
(74) *Attorney, Agent, or Firm* — Kyle R. Miiller

(57) ABSTRACT

An integrated injection system of a subsea system may include a master valve module having at least one valve and an in-line-tee (ILT) module. The master valve module may directly fluidly couple to a wellhead of the subsea system, and the ILT module may directly fluidly couple the integrated injection system to a flowline of the subsea system via a t-connection. Additionally, the integrated injection system may include a bridge module that fluidly couples the master valve module and the ILT module and is removably mounted between the master valve module and the ILT module such that components of the bridge module are removeable as an assembly. Furthermore, a common foundation may support each of the master valve module, the ILT module, and the bridge module.

19 Claims, 4 Drawing Sheets

INTEGRATED INJECTION SYSTEM

CROSS-REFERENCE TO RELATED APPLICATIONS

This application is a non-provisional application claiming priority to and the benefit of U.S. provisional application No. 63/532,856, entitled "INTEGRATED INJECTION SYSTEM," filed Aug. 15, 2023, and U.S. provisional application No. 63/535,308, entitled "INTEGRATED INJECTION SYSTEM," filed Aug. 29, 2023, both of which are hereby incorporated by reference in their entirety for all purposes.

BACKGROUND

The present disclosure relates generally to infrastructure for subsea operations. For instance, infrastructure components relating to injection systems and/or carbon capture developments may be utilized in a subsea environment and unitized on to a common foundation for increased efficiency, serviceability, and/or scalability.

Hydrocarbon fluids, such as oil and natural gas, are obtained from subterranean or subsea geologic formations, referred to as reservoirs, by drilling one or more wells that penetrates the hydrocarbon-bearing geologic formation. In subsea applications, various types of infrastructure may be positioned along a sea floor to aid in retrieving the hydrocarbon fluids. For example, hydrocarbon recovery may be enhanced by fluid injection systems that pump fluid (e.g., water) into the reservoir to maintain and/or increase pressure within the reservoir, thereby maintaining or increasing the hydrocarbon fluid pressure at production wells. Additionally or alternatively, fluid injection systems may be utilized as part of a carbon capture and sequestration (CCS) process. Moreover, the infrastructure for performing fluid injections and/or hydrocarbon extraction may include several different components with various accessories disposed in a subsea environment.

In some scenarios, the components of a fluid injection system may include valves, flowlines, chokes, controllers, etc. Moreover, in some scenarios, multiples of such components may be disposed in a subsea environment for injections or extractions at multiple locations. However, it is presently recognized that individualized components may lead to inefficiencies in fluid connections, area footprints, scalability, communications, and/or other aspects of subsea operations.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an integrated injection system of a subsea system may include a master valve module having at least one valve and an in-line-tee (ILT) module. The master valve module may directly fluidly couple to a wellhead of the subsea system, and the ILT module may directly fluidly couple the integrated injection system to a flowline of the subsea system via a t-connection. Additionally, the integrated injection system may include a bridge module that fluidly couples the master valve module and the ILT module and is removably mounted between the master valve module and the ILT module such that components of the bridge module are removeable as an assembly. Furthermore, a common foundation may support each of the master valve module, the ILT module, and the bridge module.

In another embodiment, a method for implementing an integrated injection system in a subsea system may include installing a common foundation at a well site of the subsea system and installing a wellhead of a well at the well site. The common foundation may be disposed around the wellhead. The method may also include mounting a master valve module to the common foundation and the wellhead and mounting an in-line-tee (ILT) module to the common foundation. The master valve module may include at least one valve that selectively fluidly isolates the integrated injection system from the wellhead. Moreover, mounting the master valve module may also include fluidly coupling the master valve module and the wellhead. The ILT module may fluidly couple the integrated injection system to a flowline of the subsea system. Additionally, the method may include directly coupling a bridge module to the master valve module and the ILT module. The bridge module may include an assembly of piping and additional components and fluidly couple the master valve module and the ILT module via the piping.

In another embodiment, a subsea system may include a first integrated injection system having a first master valve module that directly fluidly couples to a first wellhead of the subsea system. The first master valve module may include first valve. The first integrated injection system may also include a first in-line-tee (ILT) module to directly fluidly couple the first integrated injection system to a flowline of the subsea system via a first t-connection. Further, the flowline may be fluidly coupled to a surface platform of the subsea system. The first integrated injection system may also include a first bridge module to fluidly couple the first master valve module and the first ILT module. Additionally, the bridge module may be removably mounted between the first master valve module and the first ILT module such that first components of the first bridge module are removeable as a first assembly. The first integrated injection system may also include a first common foundation disposed around the first wellhead to support the first master valve module, the first ILT module, and the first bridge module. The subsea system may also include a second integrated injection system having a second master valve module that directly fluidly couple to a second wellhead of the subsea system. Further, the second master valve module may include a second valve. The second integrated injection system may also include a second ILT module to directly fluidly couple the second integrated injection system to the flowline via a second t-connection. As such, the first integrated injection system and the second integrated injection system may be fluidly coupled along the flowline in series via the first t-connection and the second t-connection. Moreover, the second integrated injection system may also include a second bridge module to fluidly couple the second master valve module and the second ILT module. The second bridge module may be removably mounted between the second master valve module and the second ILT module such that second components of the second bridge module are removeable as a second assembly. Furthermore, the second integrated injection system may include a second common foundation disposed around the second wellhead to support the second master valve module, the second ILT module, and the second bridge module.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
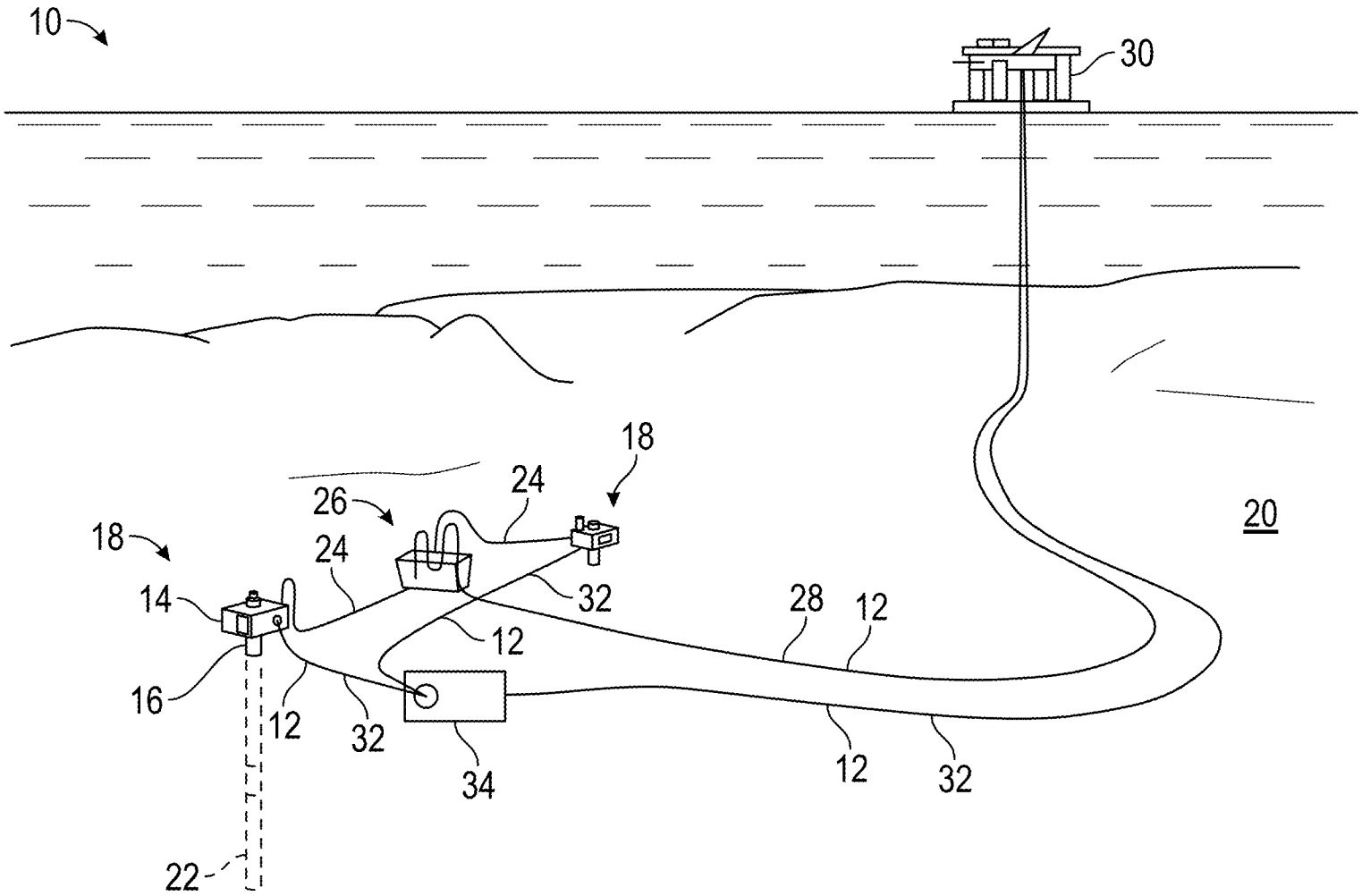
FIG. 1 a schematic view of a subsea production system including a subsea tree having an integrated injection system, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience but does not require any particular orientation of the components. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Hydrocarbon fluids, such as oil and natural gas, may be obtained from subterranean or subsea geologic formations, often referred to as reservoirs, by drilling one or more wells that penetrate the hydrocarbon-bearing geologic formation. In general, various types of infrastructure may be utilized in such an endeavor, such as fluid handling components that operate to transfer fluids from one location to another. In subsea applications, such infrastructure may be positioned underwater and/or along a sea floor to aid in retrieving the hydrocarbon fluids and/or injecting fluids. For example, carbon dioxide ($CO_2$) may be injected via a fluid injection system into the reservoir as part of a carbon capture and sequestration (CCS), also known as carbon capture and storage (CCS), process. The fluid handling components may be utilized, for example, to transfer hydrocarbons from the reservoir to a desired location, transfer fluids used in maintaining or operating the infrastructure to respective operating locations, and/or transfer injection fluids (e.g., carbon dioxide, seawater, desired chemical compositions, etc.) into the reservoir. As should be appreciated, pumps/compressors (discussed as pumps herein) may be utilized to increase the pressure of a process fluid and/or to motivate a flow of the process fluid from one location to another. Such process fluids may include but are not limited to crude oil, hydrocarbon gases (e.g., methane, ethane, propane, butane, etc.), sea water, fresh water, barrier fluids (e.g., lubricating fluids), and/or carbon dioxide (e.g., in a gas, liquid, or supercritical state).

The infrastructure of subsea applications may be positioned along a sea floor to aid in retrieving the hydrocarbon fluids. Furthermore, traditional infrastructure of subsea station may include a well and a subsea tree, also known as christmas trees, that have individualized components, which may be implemented independently. For example, a well may generally include multiple valves as well as flowline and communication connections to different components of a subsea tree to realize an injection system. Such an injection system may include components such as valves, sensors and/or chokes, and one or more distribution centers may provide/receive process fluids to/from the subsea station (e.g., injection system). However, implementing such components independently may lead to inefficiencies in production, installation, servicing, and scalability of the subsea stations (e.g., injection systems).

As such, in some embodiments, a subsea station may include a unified subsea tree having an integrated injection system. For example, the integrated injection system may utilize a master valve module, in-line-tee (ILT) module, bridge module between the master valve module and the ILT module, and communication module disposed on a common foundation (e.g., platform) at a well location (e.g., mounted on a wellhead). As used herein, a module may be a physical and/or logical conglomeration of components considered together. In certain embodiments, a module may include a framework, a housing, and/or support structure. Further, in certain embodiments, the module may include piping, flow controls (e.g., valves), and/or sensors. Moreover, in certain embodiments, the module may be described as an assembly, self-contained unit, and/or retrievable unit, which may be independent from the other modules. Furthermore, the master valve module, ILT module, and bridge module may have respective piping to support fluid flows therein and therebetween. Moreover, in some embodiments, each module may be, at least partially, pre-assembled prior to subsea installation. By integrating the components of the subsea tree onto a common foundation, the use of distribution centers and complex flowline arrangements, as well as parallel communications or other conduits, may be reduced, thus increasing simplicity and efficiency. Indeed, in some embodiments, multiple integrated injection systems may be disposed in series such that flow lines, conduits, and/or communications may be daisy chained from integrated injection system to the next for additional efficiency. For example, by eliminating or reducing homeruns to a distribution center or surface platform, the number and/or extent of flowlines, conduits, and/or pumps may be reduced. Additionally, by implementing each integrated injection system with its own components, the interdependencies and connections between such components may be standardized and/or simplified for increased production and maintenance efficiency. For example, by integrating an ILT module with a master valve module via a bridge module, the number of valves and the complexity of flowlines may be reduced. Furthermore, by modulating the simplified components of the integrated injection system, the components thereof may be more quickly and efficiently installed, removed, and/or replaced.

With the foregoing in mind, FIG. 1 is a schematic view of a subsea production system 10 that utilizes one or more pumps/compressors and/or other fluid processing machines having sealing assemblies therein, according to an embodiment of the present disclosure. In general, the subsea production system 10 may include electrical lines 12 running to a subsea tree 14 that is coupled to a wellhead 16. The subsea tree 14, wellhead 16, and/or additional components form a subsea station 18 that extracts formation fluid, such as oil and/or natural gas, from a reservoir below the sea floor 20 through the well 22. In some embodiments, the subsea production system 10 may include multiple subsea stations 18 that extract formation fluid from respective wells 22 and/or inject a process fluid into the formation. In some embodiments, formation fluid may flow through jumper cables 24 (e.g., flowlines) from the subsea tree 14 to a pipeline manifold 26. The pipeline manifold 26 may connect to one or more flowlines 28 to enable the formation fluid to flow from the wells 22 to a surface platform 30. As should be appreciated, in some embodiments, the flowlines 28 may be coupled to the subsea trees 14 with or without a pipeline manifold 26 and may be coupled in series or parallel. In some embodiments, the surface platform 30 may include a floating production, storage, and offloading unit (FPSO) or a shore-based facility. In addition to flowlines 28 that carry the formation fluid away from the wells 22 and/or process fluid to the subsea trees 14, the subsea production system 10 may include lines or conduits 32 that supply fluids (e.g., hydraulic control fluids), as well as carry control and data lines to the subsea equipment. In some scenarios, the conduits 32 may connect to a distribution module 34, which in turn couples to the subsea stations 18. In some scenarios, the surface platform 30 may be located a significant distance (e.g., greater than 100 m, greater than 1 km, greater than 10 km, or greater than 60 km) away from the wells 22. The reservoir fluids and operational fluids (e.g., barrier fluids, injection fluids) may flow between the wells 22 and the surface platform 30 via one or more pumps disposed, for example, at the surface platform 30, subsea trees 14, distribution module 34, pipeline manifold 26, etc. Moreover, after extracting hydrocarbons from the reservoir, pumps may be utilized to pump carbon dioxide back into the reservoir as part of a carbon capture and sequestration (CCS) process.

Figure 2:
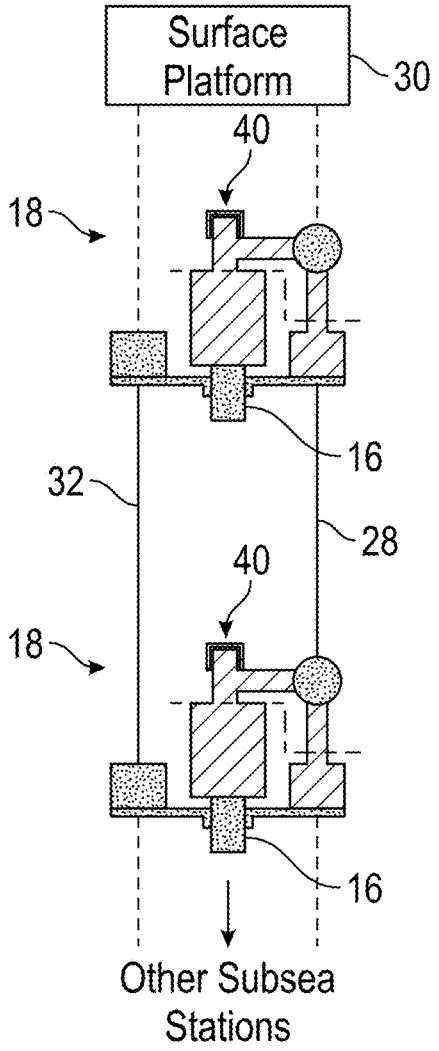
FIG. 2 is a schematic diagram of two subsea trees of FIG. 1 having integrated injection systems coupled in series, according to embodiments of the present disclosure.

As should be appreciated, for subsea hydrocarbon production and/or carbon capture and sequestration (CCS), a typical field layout may include multiple subsea stations 18, implemented at corresponding wells 22, spaced out along the sea floor 20. In some embodiments, the subsea stations 18 may be disposed and coupled in a daisy chain arrangement for suppling utilities (e.g., communications, operating fluids, etc.) and/or injection fluids and/or for retrieving extracted hydrocarbons. For example, FIG. 2 is a schematic view of two subsea stations 18 having respective integrated injection systems 40 coupled to respective wellheads 16 that share a flowline 28 and conduit 32 in a daisy chain arrangement between a surface platform 30 and other subsea stations 18. As discussed herein, the simplified nature of an integrated injection system 40 may allow for reduced usage of flowlines 28 and conduits 32 as well as reduced or eliminated usages of distribution modules 34 and pipeline manifolds 26. Such efficiencies may reduce material costs, physical and environmental footprints, and/or simplify maintenance.

Figure 3:
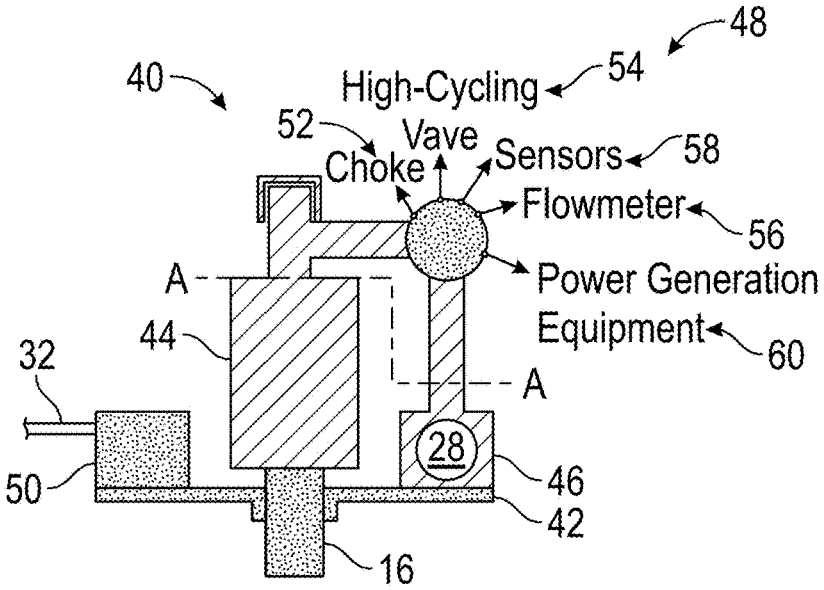
FIG. 3 is a schematic diagram of an integrated injection system as in FIG. 2, according to embodiments of the present disclosure.

As discussed herein, an integrated injection system 40, such as utilized in a subsea station 18, may be formed via modular components disposed on a common foundation 42, as shown in FIG. 3, such as to reduce the cost and complexity for the individual subsea stations 18. In some embodiments, the integrated injection system 40 may include independently retrievable sub-structures such as a master valve module 44 (e.g., master valve assembly), an in-line-tee (ILT) module 46 (e.g., ILT assembly), a bridge module 48 (e.g., bridge or bridge assembly) coupled between the master valve module 44 and the ILT module 46, and a communication module 50 (e.g., communication hardware, communication circuitry, etc.) disposed on the common foundation 42.

In general, the master valve module 44 may be coupled to the wellhead 16 for extracting hydrocarbons from and/or injecting a process fluid (e.g., carbon dioxide, seawater, etc.) into the formation, and the ILT module 46 may be coupled to one or more flowlines 28 for carrying the hydrocarbons from and/or process fluid to the integrated injection system 40. In some embodiments, the ILT module 46 may be mounted on the common foundation 42 adjacent to the master valve module 44. For example, while the master valve module 44 may be mounted vertically on top of the wellhead 16, the ILT module 46 may be disposed horizontally offset from the wellhead 16. By disposing the ILT module 46 horizontally offset from the master valve module 44 and wellhead 16, the vertical height of the subsea station 18 may be reduced, which may reduce the likelihood of inadvertent damage (e.g., due to collisions, water currents, etc.), increase structural stability, and/or provide for a more compact (e.g., low-profile) footprint. Additionally, the offset dispositions of the ILT module 46 and the master valve module 44 may assist in maintenance, installation, and/or replacement by allowing independent installation and removal of the ILT module 46 and the master valve module 44.

The integrated injection system 40 may also include a bridge module 48 that couples the master valve module 44 and the ILT module 46, allowing for fluid flows therebetween. As should be appreciated, the master valve module 44, ILT module 46, and bridge module 48 may include a number of components such as flow control components (e.g., valves) and monitoring components (e.g., sensors) for enabling the integrated injection system 40. For example, the master valve module 44 may include one or more valves (e.g., isolation valves, blowout preventers, etc.), which may be hydraulically, manually, and/or electrically actuated to isolate the well 22 from the environment and/or subsea production system 10. Similarly, the ILT module 46 may include one or more valves that isolate the integrated injection system 40 from a flowline 28. Additionally, in some embodiments, the bridge module 48 may include various additional (e.g., auxiliary) components of the integrated injection system 40. As non-limiting examples, such additional components may include a choke valve 52 (e.g., for throttling fluid flow), a high-cycling valve 54 (e.g., for regular enabling/disabling of fluid flow), a flowmeter 56 (e.g., for measuring a fluid flow rate), one or more other sensors 58 (e.g., temperature sensor, pressure sensor, optical sensor, spectrometer, etc.), and/or power generation equipment 60. For example, in some embodiments, the bridge module 48 may include power generation equipment 60 that produces electrical power for use by the integrated injection system 40, such as for valve control/operation, powering sensors, and/or powering communication hardware. As should be appreciated, such power generation equipment 60 may be of any suitable type, depending on implementation. For example, the power generation equipment 60 may generate power from the flow of fluids within the bridge module 48 (e.g., via an in-line turbine), from thermal differences between fluids within the bridge module 48 and the surrounding seawater, and/or from the flow of seawater in the environment.

In some embodiments, the bridge module 48 may incorporate components of the integrated injection system 40 that have a limited lifespan, get more regular use (e.g., under normal operations), or otherwise may be more susceptible to replacement. For example, a high-cycling valve 54 of the bridge module 48 may be utilized more regularly, under normal operations, than an isolation valve of the master valve module 44. Similarly, the bridge module 48 may include a choke valve 52 having a limited lifespan due to normal wear. Additionally, the bridge module 48 may be independently accessible with respect to the master valve module 44 and the ILT module 46. Moreover, in some embodiments, the bridge module 48 may be independently retrievable with respect to the master valve module 44 and the ILT module 46. For example, the bridge module 48 may be separated from the master valve module 44 and the ILT module 46 along cut-line A-A. As such, by utilizing high-use and/or wear prone components on the bridge module 48, more efficient maintenance may be performed. For example, the bridge module 48 may be replaced as a package including multiple sub-components thereof to reduce subsea recovery/installation operations for increased efficiency.

Figure 4:
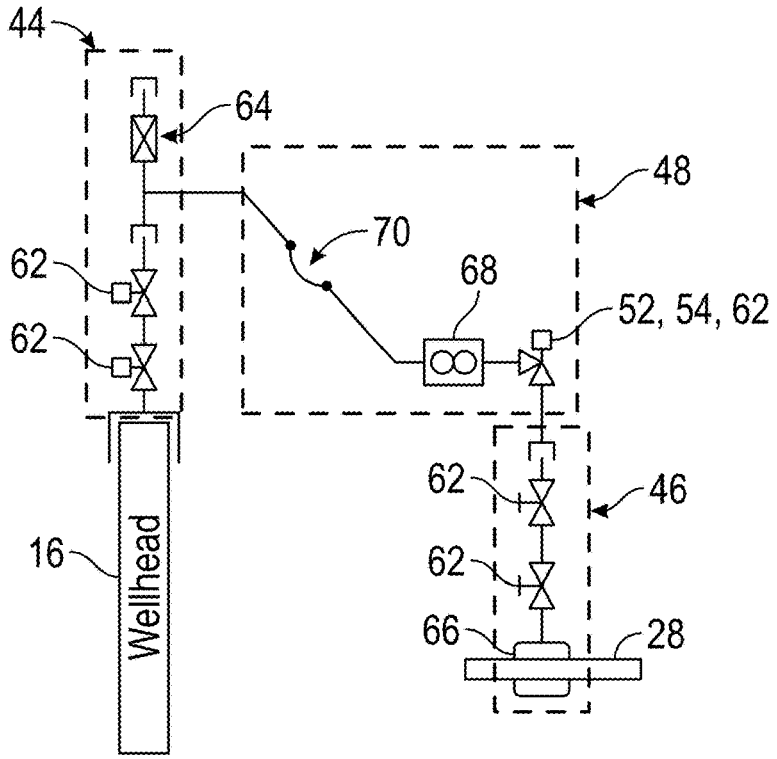
FIG. 4 is a schematic diagram of an example implementation of a master valve module, an in-line-tee (ILT) module, and bridge module of the integrated injection system of FIG. 3, according to embodiments of the present disclosure.
Figure 5:
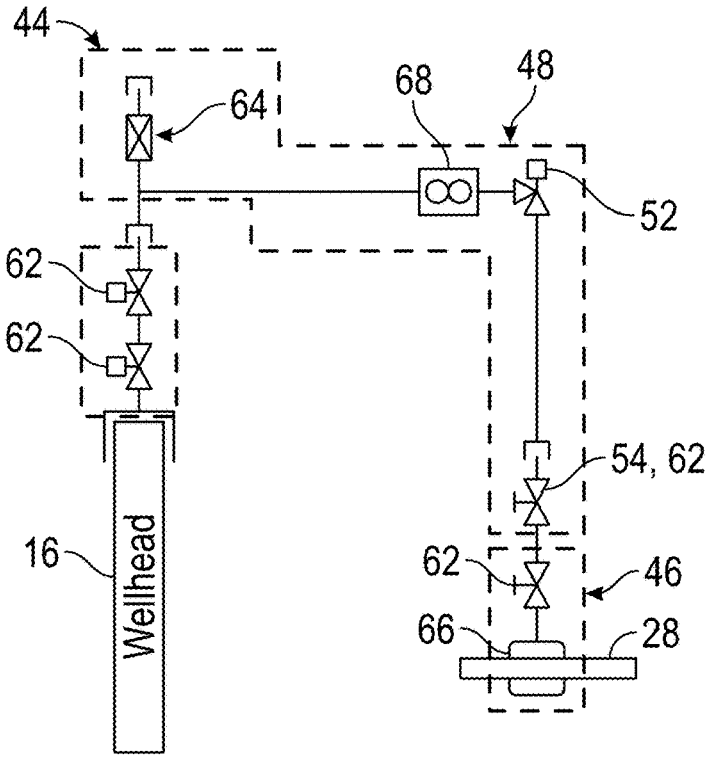
FIG. 5 is a schematic diagram of an example implementation of a master valve module, an in-line-tee (ILT) module, and bridge module of the integrated injection system of FIG. 3, according to embodiments of the present disclosure.

To help further illustrate, FIGS. 4 and 5 are schematic diagrams of example implementations of the master valve module 44, ILT module 46, and bridge module 48. In some embodiments, the master valve module 44 may be disposed vertically on top of the wellhead 16. The vertical profile of the master valve module 44 may be implemented as a vertical monobore, and by coupling the bridge module 48 to the vertical monobore, the orientation of a tubing header/tubing hanger of the wellhead 16 may be decoupled from the orientation of the flowline 28, allowing for variability in orientation of the ILT module 46 and flowline 28 relative to the position of the well 22. Additionally, in some embodiments, the master valve module 44 may have a top-entry access that may reduce or eliminate reliance on wing blocks and/or transportation flow-loops, increasing manufacturing and implementation efficiency. As discussed above, in some embodiments, the master valve module 44 may include one or multiple valves 62, such as to provide backup isolation of the well 22 relative to the rest of the integrated injection system 40 and/or the environment. For example, the valves 62 may include production valves, isolation valves, blow out preventers, flow regulation valves, etc. and may be of any suitable type such as check valves, gate valves, ball valves, and/or butterfly valves, to name a few. Furthermore, the valves 62 discussed herein may use any suitable actuator such as hydraulic, electric, and/or manual actuators. Additionally, in some embodiments, the master valve module 44 may include a tree cap 64. Alternatively, in some embodiments, the bridge module 48 may vertically couple to the master valve module 44, and the bridge module 48 may include a wireline plug or tree cap 64, allowing for top-access intervention of the master valve module 44.

Similar to the master valve module 44, the ILT module 46 may utilize one or more valves 62 to selectively enable fluid flow between the integrated injection system 40 and the flowline 28. As should be appreciated, the ILT module 46 may also utilize a second valve 62 for redundancy. The integrated nature of the integrated injection system 40 combined with the modularity of the components thereof may also afford multiple options for implementing (e.g., installing) the ILT module 46 on the common foundation 42. For example, as stated above, the bridge module 48 may help decouple the vertical orientation of the tubing header from the direction of the flowline 28. Moreover, the ILT module 46 may be implemented with a t-connection 66 with or without valves 62. Moreover, in some embodiments, the t-connection 66 may or may not includes valves that control, at least in part, flow through the flowline 28 between upstream and downstream in addition to or instead of regulating the flow to/from the integrated injection system 40. In some embodiments, the t-connection 66 may be installed when laying the piping of the flowline 28. Additionally, in some embodiments, the ILT module 46 may be installed as a cold tap into existing piping of the flowline 28.

With the foregoing in mind, the bridge module 48 may include one or multiple valves 62 (e.g., choke valve 52, high-cycling valve 54, etc.) as well as other components 68 such as the power generation equipment 60, flowmeter 56, and/or additional sensors 58. Additionally, in some embodiments, the bridge module 48 may include additional interconnections 70, such as flexible piping, to allow for variability in relative position of the master valve module 44 and the ILT module 46 and/or to increase ease/efficiency of installation, removal, and/or maintenance. As discussed herein, the bridge module 48 may contain components (e.g., other components 68) that may be desired to be retrieved, such as for repair, replacement, or relocation for use elsewhere. The integrated design of such components on the bridge module 48, as well as the modularity/individualism of the bridge module 48, ILT module 46, and master valve module 44, may allow for increased ease and efficiency at retrieving the bridge module 48 and the components thereof. Moreover, the retrievability of the bridge module 48 may also promote scalability of the integrated injection system 40 by allowing different components to be installed depending on the desired functionality at different subsea stations 18 and operational timing. For example, different sensors 58 and choke valves 52 may be utilized for production than CCS, and the bridge module 48 may be efficiently replaced to change operations without disturbing the ILT module 46 and master valve module 44 installations. As should be appreciated, while discussed herein as an integrated injection system 40, such as for injecting fluid into a formation, different bridge modules 48 may be utilized to support different functions, such as hydrocarbon production/extraction from the formation.

Returning to FIG. 3, as discussed above, the communication module 50, bridge module 48, ILT module 46, and master valve module 44 may be disposed on a common foundation 42. The communication module 50 may communicate with other subsea components such as other subsea stations 18, pipeline manifolds 26, and/or distribution modules 34 as well as the surface platform 30. Additionally, in some embodiments, the communication module 50 may function as a subsea control module (SCM) to regulate control of the bridge module 48, ILT module 46, and master valve module 44. Moreover, the communication module 50 may serve as an umbilical termination assembly (UTA). As should be appreciated, the communication module 50 may utilize any suitable form of communications such as wireless communications, wireline communications, fiber optic communications (e.g., via direct current fiber optic (DCFO) cable technology), hydrostatic communications, acoustic communications, etc. Moreover, conduits 32 may provide communication lines (e.g., via electrical lines 12, hydrostatic lines, etc.) and/or process fluids (e.g., hydraulic fluids, injection fluids, etc.) to the communication module 50. For example, the communication module 50 may receive a signal to actuate a valve 62 of the bridge module 48, ILT module 46, and/or master valve module 44 and enable one or more actuators (e.g., electrical or hydraulic actuators) to activate the desired valve. Furthermore, the communication module 50 may communicate with components of the master valve module 44, ILT module 46, and/or bridge module 48 via any suitable form of communication such as electrical lines, hydraulic lines, fiber optics, etc. The communication module 50 may include a hydraulic pump and/or receive pressurized hydraulic fluids for actuating valves 62 or other components of the integrated injection system 40. In some embodiments, the communication module 50 may include a power source and/or be coupled to power, such as via a conduit 32 and/or via a power buoy. Additionally, the communication module 50 may be disposed at any suitable location on the common foundation 42. In some embodiments, the communication module 50 may be disposed on the approximate (e.g., within 10 degrees, within 20 degrees, within 90 degrees) opposite side of the master valve module 44 than the ILT module 46 for increased spacing and installation ease.

As should be appreciated, the common foundation 42 may be of any suitable type, depending on implementation, and form a base or common structure to which each of the communication module 50, bridge module 48, ILT module 46, and master valve module 44 are coupled for stability. For example, the common foundation 42 may include a metal frame and/or metal rails for structural stability, which may be anchored on the sea floor 20. In some embodiments, the bridge module 48 may not be directly coupled to the common foundation 42, but rather coupled via the master valve module 44 and/or ILT module 46. Furthermore, the common foundation 42 may be implemented as a suction pile (e.g., micro-pile) or a mud-mat. Overall, the common foundation 42 may provide alignment and/or guidance for installing the building blocks of the integrated injection system 40 (e.g., communication module 50, bridge module 48, ILT module 46, and/or master valve module 44).

Figure 6:
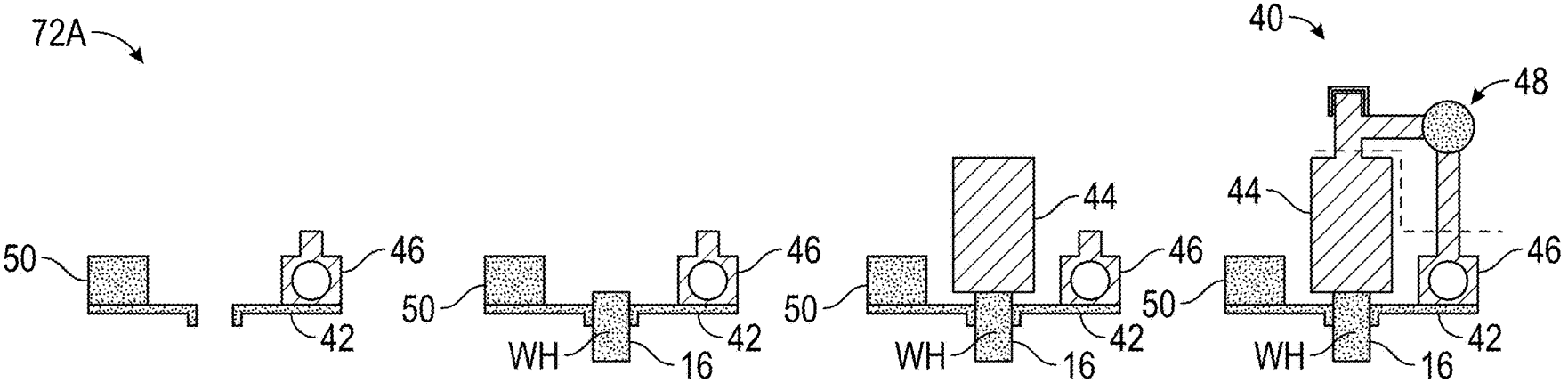
FIG. 6 is a staged illustration of an example installation process of the integrated injection system of FIG. 3, according to embodiments of the present disclosure.
Figure 7:
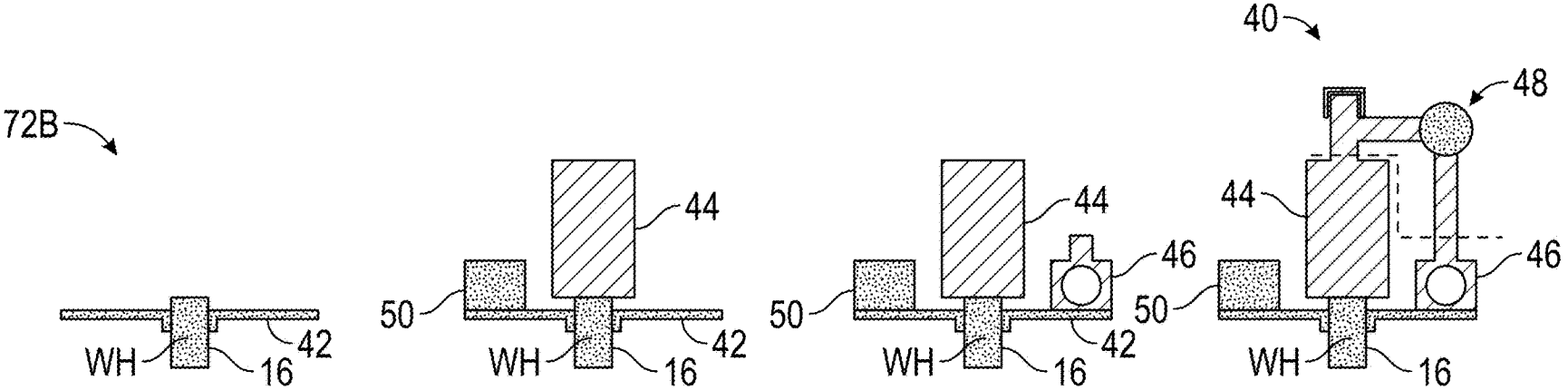
FIG. 7 is a staged illustration of an example installation process of the integrated injection system of FIG. 3, according to embodiments of the present disclosure.

FIGS. 6 and 7 illustrate example installations 72A, 72B of an integrated injection system 40. As discussed herein, the integrated injection system 40 may provide for increased efficiency in installation, maintenance, and retrieval operations as well as increased simplicity and reduced resource costs (e.g., piping, accessories, etc.). Furthermore, the integrated injection system 40 may provide for increased latitude in staging an installation and well planning. For example, in some embodiments, the common foundation 42 may be located at a future well site before the well 22 is drilled and/or before the wellhead 16 is installed, as in installation 72A. Furthermore, in some embodiments, one or more sub-components of the integrated injection system 40, such as the ILT module 46 and/or communication module 50 may be mounted on the common foundation 42 before the well 22 is drilled and/or the wellhead 16 is installed. Moreover, the common foundation 42 may be temporarily utilized during drilling or wellhead installation for support and/or guidance. After the wellhead 16 is installed, the master valve module 44 may be coupled to the wellhead 16, and the bridge module 48 may be coupled between the master valve module 44 and the ILT module 46. Alternatively, the common foundation 42 may be placed around an existing well 22 and/or wellhead 16 and the sub-components of the integrated injection system 40 may be installed thereafter, such as in installation 72B. The ordering of installation of the sub-components may generally follow that the master valve module 44 is installed after the wellhead 16 and common foundation 42 are in place, and the bridge module 48 is installed after the master valve module 44 and the ILT module 46 are in place. However, the communication module 50 and ILT module 46 may be installed freely, with respect to order, increasing operational simplicity. Moreover, in some embodiments, the common foundation 42 may be positioned at the well site, before or after wellhead installation, with one or more sub-components (e.g., the communication module 50 and/or ILT module 46) pre-mounted to the common foundation 42. As such, the integrated injection system 40 may provide for increased efficiencies (e.g., time savings, material savings, simplicity of implementation, etc.) increased latitude with regard to well planning, and increased scalability.

The technical effects of the systems and methods described herein include a subsea station 18 with a unified subsea tree 14 having an integrated injection system 40 with components disposed on a common foundation for increased installation, maintenance, and retrieval efficiencies. For example, the integrated injection system 40 may utilize a master valve module 44, an in-line-tee (ILT) module 46, a bridge module 48 coupled between the master valve module 44 and the ILT module 46, and a communication module 50 disposed. By integrating the components of the subsea tree 14 onto a common foundation 42, the use of distribution modules 34 and complex flowline arrangements, as well as parallel communications or other conduits, may be reduced, thus increasing simplicity and efficiency. Furthermore, although the above referenced flowchart is shown in a given order, in certain embodiments, process blocks may be reordered, altered, deleted, and/or occur simultaneously. Additionally, the referenced flowchart is given as an illustrative tool and further decision and process blocks may also be added depending on implementation.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. An integrated injection system of a subsea system, the integrated injection system comprising:

a master valve module comprising at least one valve and configured to directly fluidly couple to a wellhead of the subsea system;

an in-line-tee (ILT) module configured to directly fluidly couple the integrated injection system to a flowline of the subsea system via a t-connection;

a bridge module configured to fluidly couple the master valve module and the ILT module and to be removably mounted between the master valve module and the ILT module such that components of the bridge module are removeable as an assembly; and a common foundation extending radially outward from the wellhead of the subsea system, wherein the master valve module, the ILT module, and the bridge module are disposed at a plurality of positions on the common foundation.

2. The integrated injection system of claim 1, comprising a communication module mounted to the common foundation and configured to receive control signals from a surface platform and to control actuation of the at least one valve based on the control signals.

3. The integrated injection system of claim 1, wherein the bridge module comprises a choke valve configured to regulate a flow of fluid between the master valve module and the ILT module.

4. The integrated injection system of claim 3, wherein the components of the bridge module comprise a plurality of sensors configured to monitor the flow of the fluid.

5. The integrated injection system of claim 3, wherein the components of the bridge module comprise power generation equipment.

6. The integrated injection system of claim 1, wherein the master valve module comprises a vertical monobore, relative to the wellhead, and wherein the bridge module is configured to directly couple to a vertical top of the master valve module.

7. The integrated injection system of claim 6, wherein the bridge module is configured to vertically mount to the ILT module.

8. The integrated injection system of claim 6, wherein the at least one valve comprises an isolation valve configured to selectively fluidly isolate the wellhead from the bridge module.

9. The integrated injection system of claim 1, wherein the ILT module comprises one or more valves configured to selectively fluidly isolate the integrated injection system from other integrated injection systems disposed in series along the flowline.

10. The integrated injection system of claim 1, wherein the one or more positions comprise a plurality of different horizontal positions on the common foundation.

11. The integrated injection system of claim 1, wherein the master valve module, the ILT module, and the bridge module are horizontally offset from each another.

12. A method for implementing an integrated injection system in a subsea system, the method comprising:

installing a wellhead of a well at a well site of the subsea system;

installing a common foundation at the well site of the subsea system after installing the wellhead at the well site, wherein the common foundation is disposed around the wellhead;

mounting a master valve module to the common foundation and the wellhead after installing the common foundation at the well site, the master valve module comprising at least one valve configured to selectively fluidly isolate the integrated injection system from the wellhead, wherein mounting the master valve module comprises fluidly coupling the master valve module and the wellhead;

mounting an in-line-tee (ILT) module to the common foundation, the ILT module comprising one or more valves, wherein the ILT module is configured to fluidly couple the integrated injection system to a flowline of the subsea system; and directly coupling a bridge module to the master valve module and the ILT module after mounting the master valve module to the common foundation, the bridge module comprising an assembly of piping and flow control components, wherein the bridge module is configured to fluidly couple the master valve module and the ILT module via the piping.

13. The method of claim 12, wherein the flow control components comprise a choke valve configured to regulate a flow of fluid through the piping, wherein the assembly comprises the piping, the flow control components, and one or more sensors configured to monitor the flow of the fluid through the piping, and wherein the assembly is pre-assembled prior to coupling of the bridge module to the master valve module.

14. The method of claim 12, comprising mounting a communication module to the common foundation, the communication module configured to communicate signals with a surface platform of the subsea system and to control operation of the at least one valve of the master valve module, the one or more valves of the ILT module, and the flow control components of the bridge module based on the communicated signals.

15. The method of claim 14, wherein the ILT module, the communication module, or both are mounted to the common foundation prior to installing the common foundation at the well site.

16. The method of claim 12, wherein the master valve module is mounted vertically on top of the wellhead, the ILT module is mounted laterally adjacent to the wellhead, and the piping of the bridge module is configured to vertically fluidly couple to the master valve module and vertically fluidly couple to the ILT module.

17. A subsea system comprising:

a first integrated injection system comprising:

a first master valve module comprising a first valve and configured to directly fluidly couple to a first wellhead of the subsea system;

a first in-line-tee (ILT) module configured to directly fluidly couple the first integrated injection system to a flowline of the subsea system via a first t-connection, wherein the flowline is fluidly coupled to a surface platform of the subsea system;

a first bridge module configured to fluidly couple the first master valve module and the first ILT module and to be removably mounted between the first master valve module and the first ILT module such that first components of the first bridge module are removeable as a first assembly; and a first common foundation disposed around the first wellhead and extending radially outward from the first wellhead, wherein the first master valve module, the first ILT module, and the first bridge module are disposed at a first plurality of positions on the first common foundation; and a second integrated injection system comprising:

a second master valve module comprising a second valve and configured to directly fluidly couple to a second wellhead of the subsea system;

a second ILT module configured to directly fluidly couple the second integrated injection system to the flowline of the subsea system via a second t-connection, wherein the first integrated injection system and the second integrated injection system are fluidly coupled along the flowline in series via the first t-connection and the second t-connection;

a second bridge module configured to fluidly couple the second master valve module and the second ILT module and to be removably mounted between the second master valve module and the second ILT module such that second components of the second bridge module are removeable as a second assembly; and a second common foundation disposed around the second wellhead and extending radially outward from the second wellhead, wherein the second master valve module, the second ILT module, and the second bridge module are disposed at a second plurality of positions on the second common foundation.

18. The subsea system of claim 17, wherein the first integrated injection system comprises a first communication module mounted to the first common foundation, wherein the first communication module is configured to communicate first signals with the surface platform via a conduit and to control operation of the first valve and the first components of the first bridge module based on the communicated first signals.

19. The subsea system of claim 18, wherein the second integrated injection system comprises a second communication module mounted to the second common foundation, wherein the second communication module is configured to communicate second signals with the surface platform via the conduit and to control operation of the second valve and the second components of the second bridge module based on the communicated second signals, wherein the first communication module and the second communication module are communicatively coupled in series via the conduit.

* * * * *